US009938804B2

(12) United States Patent
Haarstad et al.

(10) Patent No.: US 9,938,804 B2
(45) Date of Patent: Apr. 10, 2018

(54) PUMP JACK ASSEMBLY

(71) Applicant: G.E.T. Hydraulics Ltd., Bentley (CA)

(72) Inventors: Everett Allan Haarstad, Bentley (CA); Tyler Haarstad, Bentley (CA); Gordon Ray Abram, Sylvan Lake (CA)

(73) Assignee: G.E.T. Hydraulics, LTD, Bentley (CA)

( * ) Notice: Subject to any disclaimer, the term of this patent is extended or adjusted under 35 U.S.C. 154(b) by 0 days.

(21) Appl. No.: 13/929,585

(22) Filed: Jun. 27, 2013

(65) Prior Publication Data

US 2015/0000930 A1 Jan. 1, 2015

(51) Int. Cl.

| | |
|---|---|
| ***E21B 43/12*** | (2006.01) |
| *F04B 47/02* | (2006.01) |
| *F04B 47/04* | (2006.01) |

(52) U.S. Cl.

CPC ..... *E21B 43/127* (2013.01); *E21B 43/126* (2013.01); *E21B 43/124* (2013.01); *F04B 47/022* (2013.01); *F04B 47/04* (2013.01)

(58) Field of Classification Search

CPC ..... E21B 43/126; E21B 43/127
See application file for complete search history.

(56) References Cited

U.S. PATENT DOCUMENTS

| | | | | |
|---|---|---|---|---|
| 3,277,730 | A * | 10/1966 | Chastain | F16F 15/261 74/41 |
| 4,238,966 | A | 12/1980 | Carlson et al. | |
| 4,249,376 | A | 2/1981 | Weckerly | |
| 4,353,445 | A * | 10/1982 | Moss | 192/224 |
| 4,406,122 | A * | 9/1983 | McDuffie | 60/368 |
| 5,996,688 | A | 12/1999 | Schultz et al. | |
| 7,490,674 | B2 | 2/2009 | Brecheisen | |
| 7,533,730 | B1 * | 5/2009 | Corsentino | E21B 43/127 166/250.15 |
| 2003/0075321 | A1 * | 4/2003 | Hall | 166/241.1 |
| 2006/0024177 | A1 * | 2/2006 | Robison | F04L 347/04 417/390 |
| 2006/0032222 | A1 * | 2/2006 | Slattery et al. | 60/500 |
| 2009/0055029 | A1 * | 2/2009 | Roberson et al. | 700/282 |

FOREIGN PATENT DOCUMENTS

| | | |
|---|---|---|
| CA | 2631861 | 11/2009 |

OTHER PUBLICATIONS

"Pumpjack", Wikipedia [online], http://en.wikipedia.org/wiki/Pumpjack, accessed Jun. 18, 2013.

"Rotaflex Long-Stroke Pumping Unit", Weatherford International Ltd., Houston, Texas, 2007.

* cited by examiner

*Primary Examiner* — Giovanna C. Wright
*Assistant Examiner* — Kristyn A Hall
(74) *Attorney, Agent, or Firm* — Lewellyn Law, PLLC; Stephen Lewellyn

(57) ABSTRACT

A pump jack assembly has a horsehead mounted to rock on a frame; a polished rod connected to the horsehead; and a hydraulic motor connected to rock the horsehead. The pump jack assembly may have a crank assembly connected between the hydraulic motor and the horsehead, the crank assembly having one or more counterweights; a hydraulic pump; a fluid supply line and a fluid return line between the hydraulic pump and hydraulic motor; and a hydraulic brake on the fluid return line. A method of providing a pump jack assembly includes replacing a non hydraulic pump jack motor, connected to rock the horsehead, with a hydraulic motor.

2 Claims, 1 Drawing Sheet

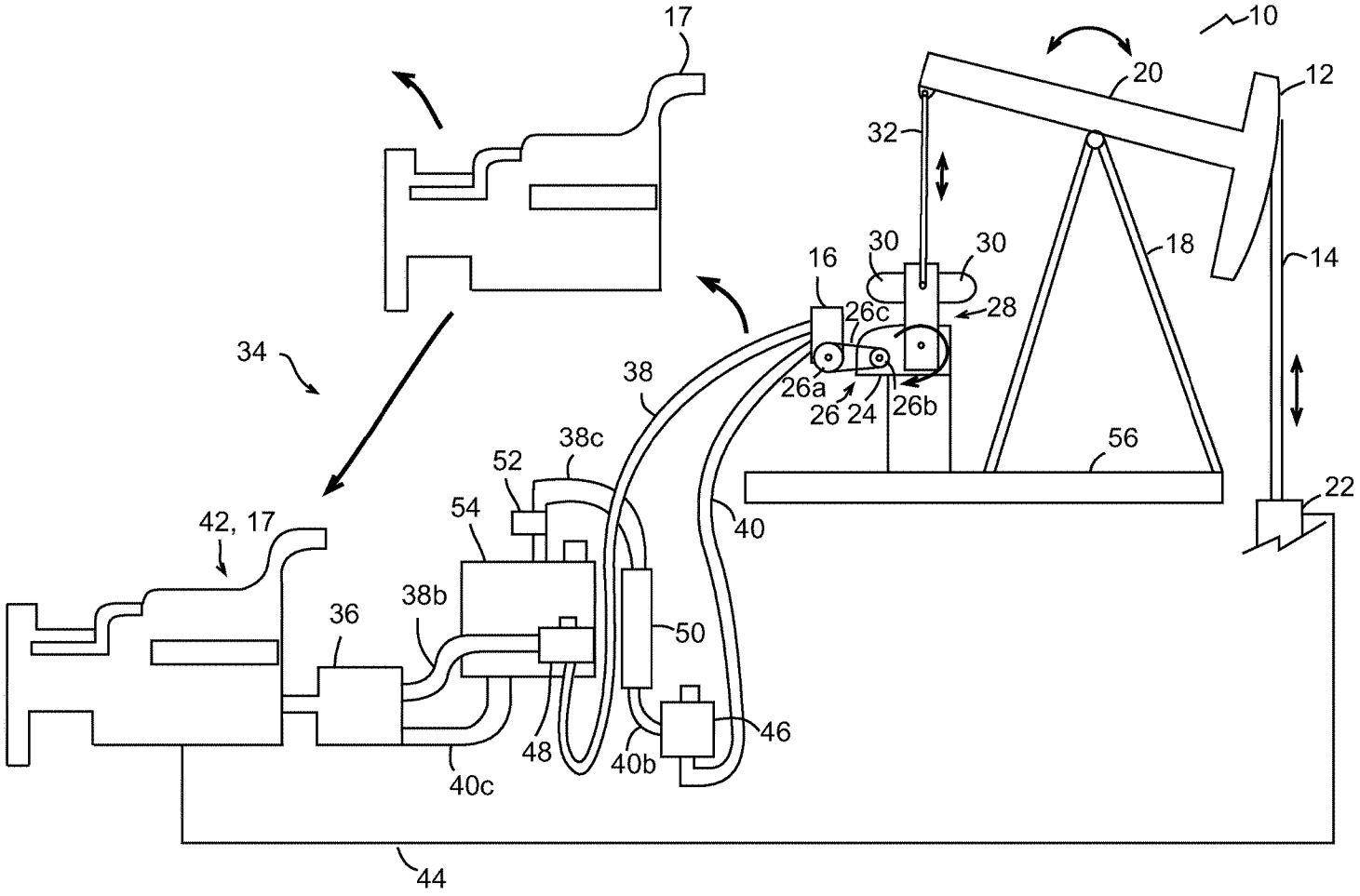
10
12
14
22
20
18
56
30
28
32
30
26c
26b
24
16
26
26a
40
46
17
50
38
40b
38c
48
52
54
40c
38b
44
36
34
42, 17

PUMP JACK ASSEMBLY

TECHNICAL FIELD

This document relates to pump jack assemblies.

BACKGROUND

Pump jacks are used to pump oil and fluids out of wells across the world. Pump jacks are powered by electric or fuel-powered engines connected to a transmission using belts or sheaves. The transmission turns a crank that rocks a horsehead back and forth. The rocking horsehead reciprocates a polished rod connected by sucker rods to a downhole pump. Oil is returned up the well tubing and gas returns through the annulus between the tubing and casing. Vertical stroke pumping systems like the Rotaflex™ system have been developed as a replacement for pump jacks.

SUMMARY

A pump jack assembly comprising: a horsehead mounted to rock on a frame; a polished rod connected to the horsehead; and a hydraulic motor connected to rock the horsehead.

In various embodiments, there may be included any one or more of the following features: The pump jack assembly further comprises: a crank assembly connected between the hydraulic motor and the horsehead, the crank assembly having one or more counterweights; a hydraulic pump; a fluid supply line and a fluid return line between the hydraulic pump and hydraulic motor; and a hydraulic brake on the fluid return line. A flow control valve is on the fluid supply line. A transmission is connected between the horsehead and a chain and sprocket assembly, which is connected to the hydraulic motor. The pump jack assembly is provided by replacing a non hydraulic pump jack motor, connected to rock the horsehead, with the hydraulic motor.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

The FIGURE is a side schematic view of a pump jack assembly.

DETAILED DESCRIPTION

Immaterial modifications may be made to the embodiments described here without departing from what is covered by the claims.

A pump jack (also called a nodding donkey, pumping unit, horsehead pump, rocking horse, beam pump, dinosaur, sucker rod pump, grasshopper pump, thirsty bird, or jack pump) is the overground drive for a reciprocating piston pump in an oil well. Pump jacks are used to mechanically lift liquid out of the well when there is not enough bottom hole pressure for the liquid to flow all the way to the surface. Pump jacks are commonly used for onshore wells producing little oil.

Depending on the size of the pump, a pump jack generally produces five to forty litres of liquid at each stroke. Often this is an emulsion of crude oil and water. Pump size is also determined by the depth and weight of the oil to remove, with deeper extraction requiring more power to move the increased weight of the discharge column (discharge head).

A pump jack converts the rotary mechanism of a motor to a vertical reciprocating motion to drive the pump shaft, and is exhibited in the characteristic nodding motion. The engineering term for such a mechanism is a walking beam.

Modern pump jacks are powered by a prime mover, which is an electric motor or internal combustion engine. Common off-grid pump jack engines run on casing gas produced from the well, but pump jacks have been run on many types of fuel, such as propane and diesel fuel. In harsh climates such motors and engines may be housed in a shack for protection from the elements.

The prime mover of the pump jack runs a set of pulleys or belts on sheaves to the transmission, which drives a pair of cranks, generally with counterweights on them to assist the motor in lifting the heavy string of rods. The cranks raise and lower one end of an I-beam which is free to move on an A-frame. Positioned on the other end of the beam is a curved metal box called a horse head or donkey head, so named due to its appearance. A cable made of steel or fiberglass, called a bridle, connects the horse head to the polished rod, which is a piston that passes through the stuffing box.

The polished rod has a close fit to the stuffing box, permitting the rod to move in and out of the tubing without permitting fluid escape. The tubing is a pipe that runs to the bottom of the well through which the liquid is produced. The bridle follows the curve of the horse head as the head lowers and raises to create a nearly vertical stroke. The polished rod is connected to a long string of rods called sucker rods, which run through the tubing to the down-hole pump, usually positioned near the bottom of the well.

At the bottom of the tubing is a down-hole pump. This pump usually has two check valves: a stationary valve at bottom called the standing valve, and a valve on the piston connected to the bottom of the sucker rods that travels up and down as the rods reciprocate, known as the traveling valve. Reservoir fluid enters from the formation into the bottom of the borehole through perforations that have been made through the casing and cement.

When the rods at the pump end are traveling up, the traveling valve is closed and the standing valve is open (due to the drop in pressure in the pump barrel). Consequently, the pump barrel fills with the fluid from the formation as the traveling piston lifts the previous contents of the barrel upwards. When the rods begin pushing down, the traveling valve opens and the standing valve closes (due to an increase in pressure in the pump barrel). The traveling valve drops through the fluid in the barrel (which had been sucked in during the upstroke). The piston then reaches the end of its stroke and begins its path upwards again, repeating the process.

Referring to The FIGURE, a pump jack assembly 10 is illustrated, having a horsehead 12, a polished rod 14, and a hydraulic motor 16. Horsehead 12 is mounted to rock back and forth on a frame such as an A-frame 18. Horsehead 12 may be connected to frame 18 through a walking beam 20. Polished rod 14 is connected to horsehead 12 and may be inserted through a stuffing box (not shown) into a well 22. Rod 14 may connect to horsehead 12 through a carrier bar (not shown) and cables (not shown).

Hydraulic motor 16 is connected to rock the horsehead 12. In the example shown, motor 16 connects to a transmission 24 through a chain and sprocket assembly 26 having a drive sprocket 26*a*, a driven sprocket 26*b*, and a chain 26*c*. Sprocket 26*b* may be mounted directly to gear box or transmission 24 using a bracket (not shown) and existing holes (not shown) in the housing of the transmission 24. A chain and sprocket assembly 26 is less prone to slipping during use than is a belt and sheave assembly (not shown). Transmission 24, which may be a gear reducer, may connect to beam 20 through a crank assembly 28 having one or more counterweights 30. Thus, motor 16 uses chain and sprocket assembly 26 to transfer rotational energy to transmission 24, which transmits rotational energy to crank assembly 28, which converts such energy into reciprocal motion of horsehead 12, thus reciprocating rod 14 in and out of the well 22. Crank assembly 28 may connect to beam 20 through one or more lever arms 32.

Hydraulic motor 16 may form part of a hydraulic power system 34. System 34 may include a hydraulic pump 36 and fluid supply and return lines 38 and 40, respectively, between the hydraulic pump 36 and hydraulic motor 16. Pump 36 may be driven by a motor 42, which may be a diesel, natural gas, or electrical motor. In the example shown motor 42 is powered by gas takeoff from well 22 through gas line 44.

A hydraulic brake 46 may be positioned on return line 40. Brake 46 may act to restrict flow speed of fluid returning from motor 16. In a conventional pump jack assembly that contains anon hydraulic motor 17 connected to transmission 24 through a belt and sheave assembly (not shown), rotational speed of crank assembly 28 speeds up as counterweights 30 begin a downstroke from the position shown, and slows down as counterweights 30 begin an upstroke. Such imbalanced rotation wears down the belt and sheave system over time. However, in assembly 10 brake 46 restricts or eliminates motor 16 from speeding up or slowing down as a result of crank 28 action, thus serving to correct and restrict rotational imbalances caused by counterweights 30. Smoother operation results. The brake may be adjustable, for example depending on the balance of the weights 30 compared to the rod weight. The brake 46 may include a counterbalance valve (not shown), which may include a spring assembly and a set screw to adjust resistance.

A flow control valve 48 may be positioned on the fluid supply line 38 to provide variable speed drive. Flow control valve 48 may be used to speed up or slow down pump jack 10 speed on demand, for example by adjusting the set point on valve 48. Thus, pump jack speed can be sped up or slowed down in seconds, permitting the pump speed to be tailored to match the rate at which the well 22 is producing. By contrast, speed changes in a belt and sheave system may require manually changing the size of the sheaves.

Other components may be used as desired, and may not be shown in the drawings, for example a rod rotator. Fluid may be returned from line 40 through an oil cooler 50, a filter 52, and into an oil tank 54. Oil cooler 50 may include a radiator (not shown) with electric fan (not shown) and thermostat (not shown) to keep the oil from over heating. Fluid may be drawn from tank 54 into pump 36 and passed through valve 48 into motor 16. Flow lines 38*b* and 38*c* are understood as forming part of supply line 38, while lines 40*b* and 40*c* are understood as forming part of return line 40.

Pump jack assembly 10 may be mounted at least partially on a pump jack pad 56 as shown. In a conventional pump jack system, pad 56 mounts the prime mover or motor 17. In assembly 10, pad 56 may mount all, some, or none of the components of hydraulic system 34, thus providing flexibility in the location of components. In some cases the components of system 34 may be provided on a separate skid or trailer (not shown).

In some cases a conventional pump jack assembly may be retrofitted with motor 16 to produce assembly 10. For example, an existing non hydraulic pump jack motor 17 may be replaced by hydraulic motor 16, by removing the motor 17 and inserting in its place hydraulic motor 16 and a new prime mover 42, or by connecting hydraulic motor 16 between motor 17 (also shown by reference numeral 42) and the transmission 24.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A pump jack assembly comprising:

a walking beam pivotally mounted to a frame;

a horsehead attached to a first end of said walking beam;

a lever arm attached to a second end of said walking beam;

a crank assembly operatively attached to said lever arm, said crank assembly having one or more counterweights, wherein rotation of said crank assembly causes said walking beam to pivot and rock said horsehead;

a hydraulic motor operatively connected to said crank assembly to rotatingly drive said crank assembly;

a hydraulic pump operatively connected to said hydraulic motor to drive said hydraulic motor by a fluid supply line and a fluid return line;

a prime mover operatively connected to said hydraulic pump to drive said hydraulic pump;

a hydraulic brake fluidically connected to said fluid return line between said hydraulic motor and said hydraulic pump, said hydraulic brake restricts a flow of hydraulic fluid through said fluid return line preventing said hydraulic motor from speeding up between an upstroke and downstroke of said crank assembly; and a flow control valve fluidically connected to said fluid supply line between said hydraulic motor and said hydraulic pump, said flow control valve having an adjustable setpoint that controls the rotational speed of said hydraulic motor without changing the rotational speed of said prime mover.

2. The assembly of claim 1, further comprising:

a chain and sprocket assembly operatively connecting said hydraulic motor and said lever arm.

* * * * *